US010601179B2

(12) United States Patent
Hashiguchi

(10) Patent No.: US 10,601,179 B2
(45) Date of Patent: Mar. 24, 2020

(54) CONNECTOR

(71) Applicant: JAPAN AVIATION ELECTRONICS INDUSTRY, LIMITED, Shibuya-ku, Tokyo (JP)

(72) Inventor: Osamu Hashiguchi, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/421,526

(22) Filed: May 24, 2019

(65) Prior Publication Data

US 2020/0052440 A1 Feb. 13, 2020

(30) Foreign Application Priority Data

Aug. 8, 2018 (JP) ..... 2018-149402

(51) Int. Cl.
*H01R 12/00* (2006.01)
*H01R 13/631* (2006.01)
*H01R 12/71* (2011.01)

(52) U.S. Cl.
CPC ..... *H01R 13/6315* (2013.01); *H01R 12/716* (2013.01)

(58) Field of Classification Search
CPC .... H01R 12/71; H01R 12/712; H01R 12/716; H01R 13/6315
USPC ..... 439/65, 74, 247, 660
See application file for complete search history.

(56) References Cited

U.S. PATENT DOCUMENTS

| | | | |
|---|---|---|---|
| 7,354,279 | B2 | 4/2008 | Uesaka |
| 7,637,762 | B2 | 12/2009 | Uesaka |
| 7,901,218 | B2 | 3/2011 | Sato et al. |
| 10,062,995 | B2 | 8/2018 | Doi |
| 2015/0044915 | A1 | 2/2015 | Takaki |

FOREIGN PATENT DOCUMENTS

| | | | |
|---|---|---|---|
| JP | 2007149477 | A | 6/2007 |
| JP | 5250450 | B2 | 4/2013 |
| JP | 5457595 | B1 | 4/2014 |
| JP | 2014225469 | A | 12/2014 |
| JP | 2017111918 | A | 6/2017 |
| JP | 2018037151 | A | 3/2018 |

*Primary Examiner* — Khiem M Nguyen
(74) *Attorney, Agent, or Firm* — Holtz, Holtz & Volek PC

(57) ABSTRACT

A connector comprises a fixed housing, a movable housing and a plurality of contacts. The fixed housing has a housing-accommodation portion. The movable housing is, at least in part, accommodated in the housing-accommodation portion and is movable relative to the fixed housing. The movable housing has a plurality of contact-accommodation portions which correspond to the contacts, respectively. Each of the contacts has a resiliently deformable portion which is resiliently deformable. Each of the resiliently deformable portions has an accommodated portion which is accommodated in the corresponding contact-accommodation portion. Each of the resiliently deformable portions is provided with a first contact point and a second contact point. The first contact point and the second contact point of each of the contacts face each other in a width direction (X-direction).

10 Claims, 10 Drawing Sheets

CONNECTOR

CROSS REFERENCE TO RELATED APPLICATIONS

This application is based on and claims priority under 35 U.S.C. § 119 to Japanese Patent Application No. JP2018-149402 filed Aug. 8, 2018, the content of which is incorporated herein in its entirety by reference.

BACKGROUND OF THE INVENTION

This invention relates to a floating connector comprising a contact having two contact points.

For example, a connector which comprises a contact having two contact points is disclosed in JP5457595B (Patent Document 1), the content of which is incorporated herein by reference.

Referring to FIG. 17, Patent Document 1 discloses a connector 90 which comprises a housing 92 and a plurality of terminals (contacts) 96 held by the housing 92. The housing 92 has a peripheral wall 922 and a standing wall 924. Referring to FIG. 18, each of the contacts 96 has a front resilient arm 962 provided with a front contact point 964 and a rear resilient arm 966 provided with a rear contact point 968. Each of the front resilient arm 962 and the rear resilient arm 966 extends long in an upper-lower direction (mating direction) so as to be easily resiliently deformable. When the connector 90 is mated with a mating connector (not shown), each of the front resilient arm 962 and the rear resilient arm 966 is resiliently deformed, and the two contact points, namely the front contact point 964 and the rear contact point 968, are brought into contact with a mating contact (not shown).

As can be seen from FIG. 17, when the standing wall 924 is formed to be movable relative to the peripheral wall 922, the connector 90 of Patent Document 1 is a floating connector comprising a plurality of the contacts 96 each having the two contact points.

In general, a contact of a floating connector is preferred to have two contact points in order to be reliably brought into contact with a mating contact. However, the contact of Patent Document 1 needs to be long in the mating direction. As a result, a floating connector comprising the contact of Patent Document 1 tends to have a large size in the mating direction.

SUMMARY OF THE INVENTION

It is therefore an object of the present invention to provide a floating connector which comprises a contact having two contact points but can be reduced in size in a mating direction.

An aspect of the present invention provides a connector mateable with a mating connector along an upper-lower direction. The connector comprises a fixed housing, a movable housing and a plurality of contacts. The fixed housing has a housing-accommodation portion and a plurality of holding portions which correspond to the contacts, respectively. The housing-accommodation portion opens upward. The holding portions are arranged in a pitch direction perpendicular to the upper-lower direction. The movable housing is, at least in part, accommodated in the housing-accommodation portion. The movable housing is movable relative to the fixed housing along the upper-lower direction and is movable relative to the fixed housing along a horizontal plane perpendicular to the upper-lower direction. The movable housing has a receiving portion, one or more partitions and a plurality of contact-accommodation portions which correspond to the contacts, respectively. The receiving portion opens upward and receives, at least in part, the mating connector under a mated state where the connector and the mating connector are mated with each other. The contact-accommodation portions are arranged in the pitch direction and communicate with the receiving portion in a width direction perpendicular to both the upper-lower direction and the pitch direction. Each of the partitions is located between adjacent two of the contact-accommodation portions in the pitch direction. Each of the contacts has a held portion and a resiliently deformable portion. Each of the held portions is held by a corresponding one of the holding portions. Each of the resiliently deformable portions is resiliently deformable and has an accommodated portion. Each of the accommodated portions is accommodated in a corresponding one of the contact-accommodation portions under a separated state where the connector and the mating connector are separated from each other. Each of the resiliently deformable portions is provided with a first contact point and a second contact point. The first contact point and the second contact point of each of the contacts face each other in the width direction under the separated state.

According to an aspect of the present invention, the movable housing of the connector is movable relative to the fixed housing of the connector. In addition, each of the contacts according to an aspect of the present invention has two contact points, namely the first contact point and the second contact point. Thus, the connector according to an aspect of the present invention is a floating connector comprising the contacts each having the two contact points.

According to an aspect of the present invention, each of the resiliently deformable portions, which is resiliently deformable, can be shaped to have the two contact points, or the first contact point and the second contact point. For example, by shaping the resiliently deformable portion in a meander shape, the contact can be reduced in size in the upper-lower direction (mating direction) while keeping spring characteristics of the resiliently deformable portion, so that the connector can be reduced in size in the mating direction.

An appreciation of the objectives of the present invention and a more complete understanding of its structure may be had by studying the following description of the preferred embodiment and by referring to the accompanying drawings.

Figure 1:
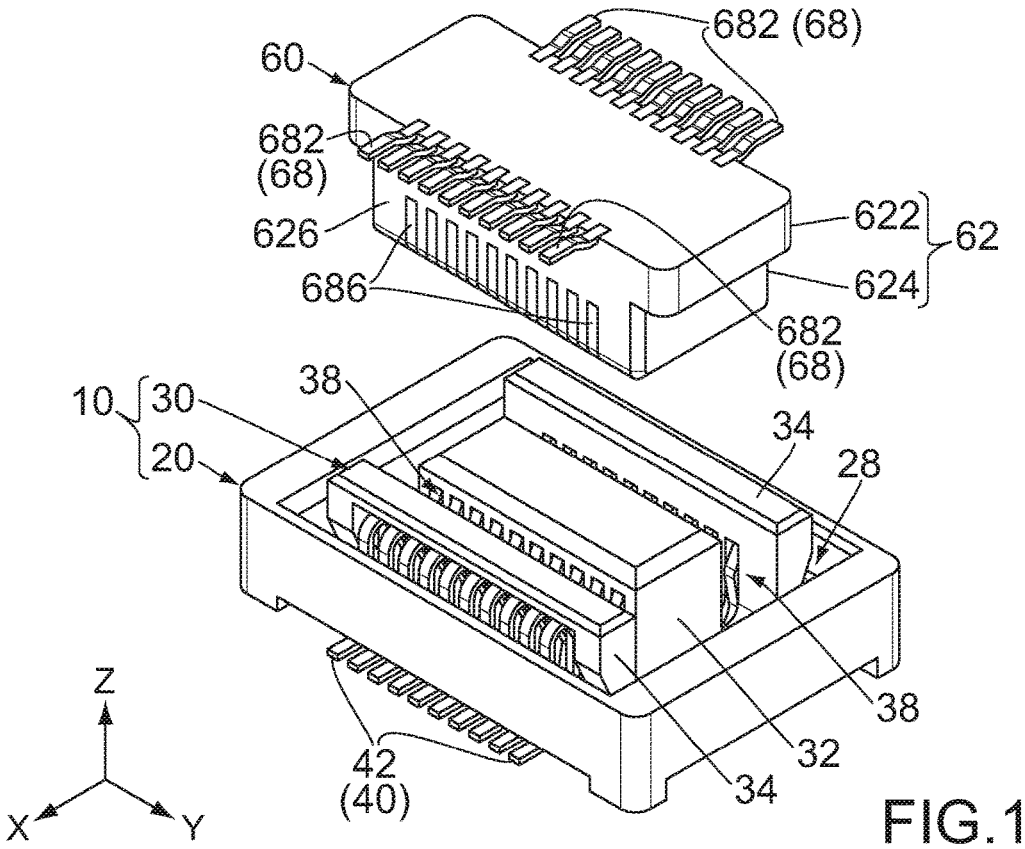
FIG. 1 is a perspective view showing a connector and a mating connector according to an embodiment of the present invention, wherein the connector and the mating connector are separated from each other.
Figure 2:
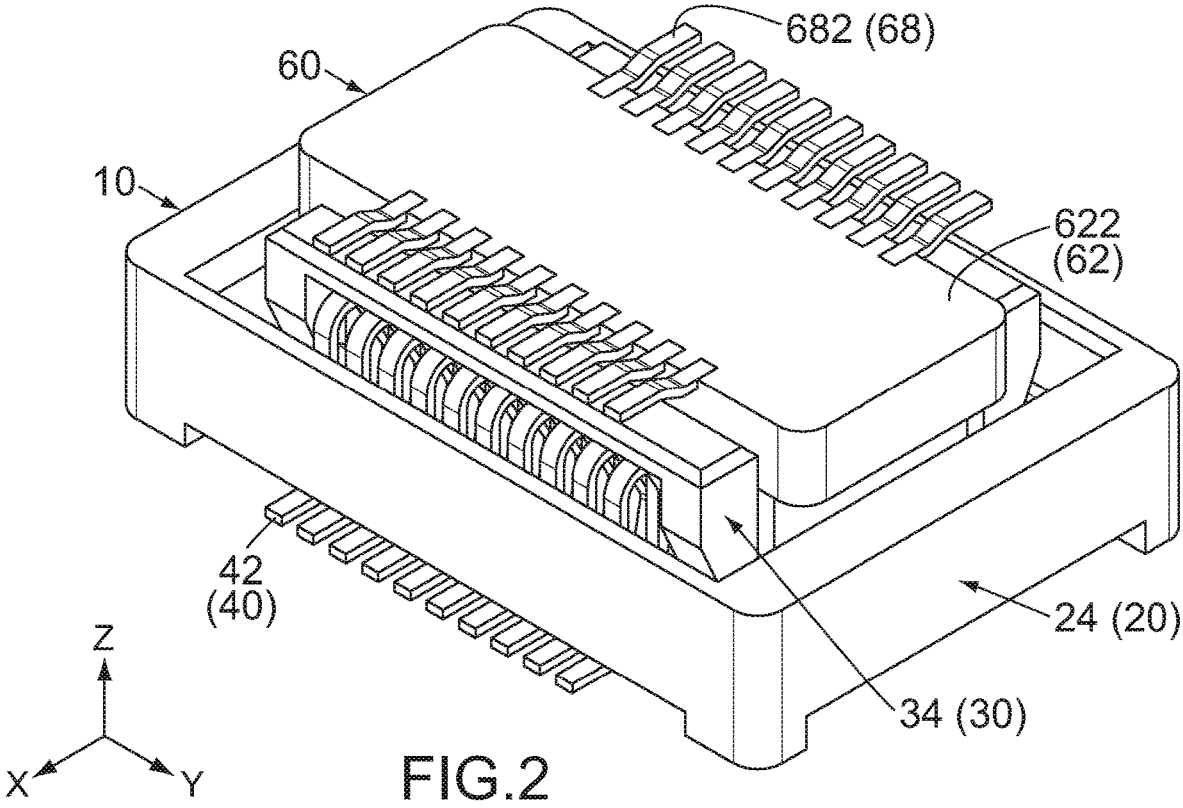
FIG. 2 is a perspective view showing the connector and the mating connector of FIG. 1, wherein the connector and the mating connector are mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIGS. 1 to 4, a connector 10 according to an embodiment of the present invention is mateable with a mating connector 60 along an upper-lower direction (Z-direction: mating direction). The mating connector 60 mated with the connector 10 is removable from the connector 10 along the Z-direction. In the present embodiment, the connector 10 is an on-board connector which is to be mounted on a circuit board 82, and the mating connector 60 is another on-board connector which is to be mounted on a mating circuit board 86. Moreover, the connector 10 is a receptacle, and the mating connector 60 is a plug. However, the present invention is not limited thereto but is applicable to various connectors.

Figure 7:
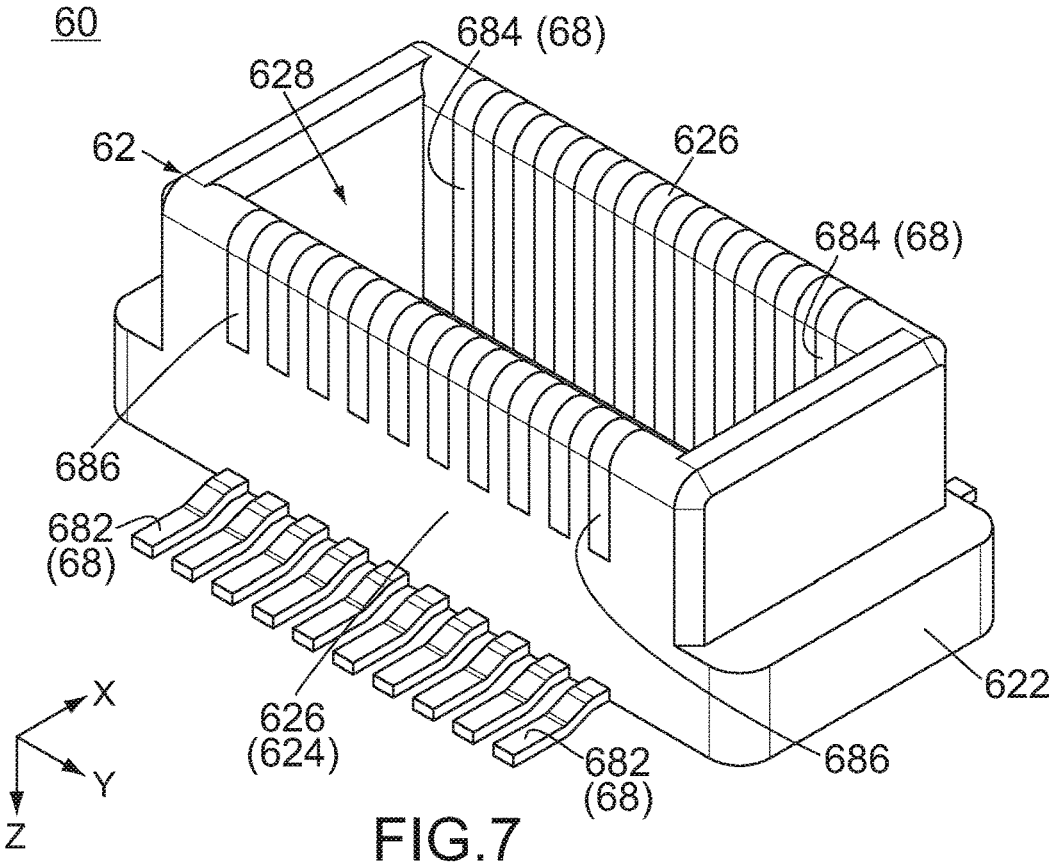
FIG. 7 is a perspective view showing the mating connector of FIG. 1.
Figure 8:
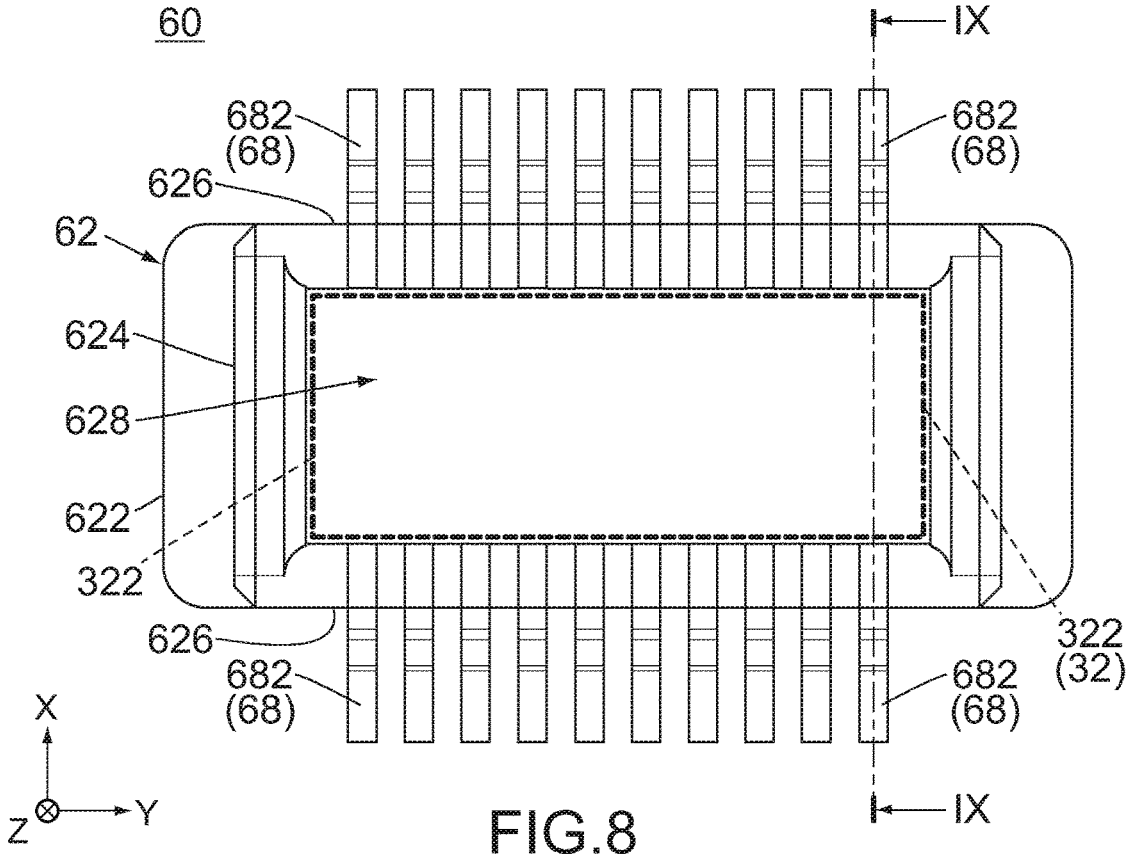
FIG. 8 is a plan view showing the mating connector of FIG. 7, wherein dashed line illustrates an outline of a middle portion of the movable housing of the connector mated with the mating connector.
Figure 9:
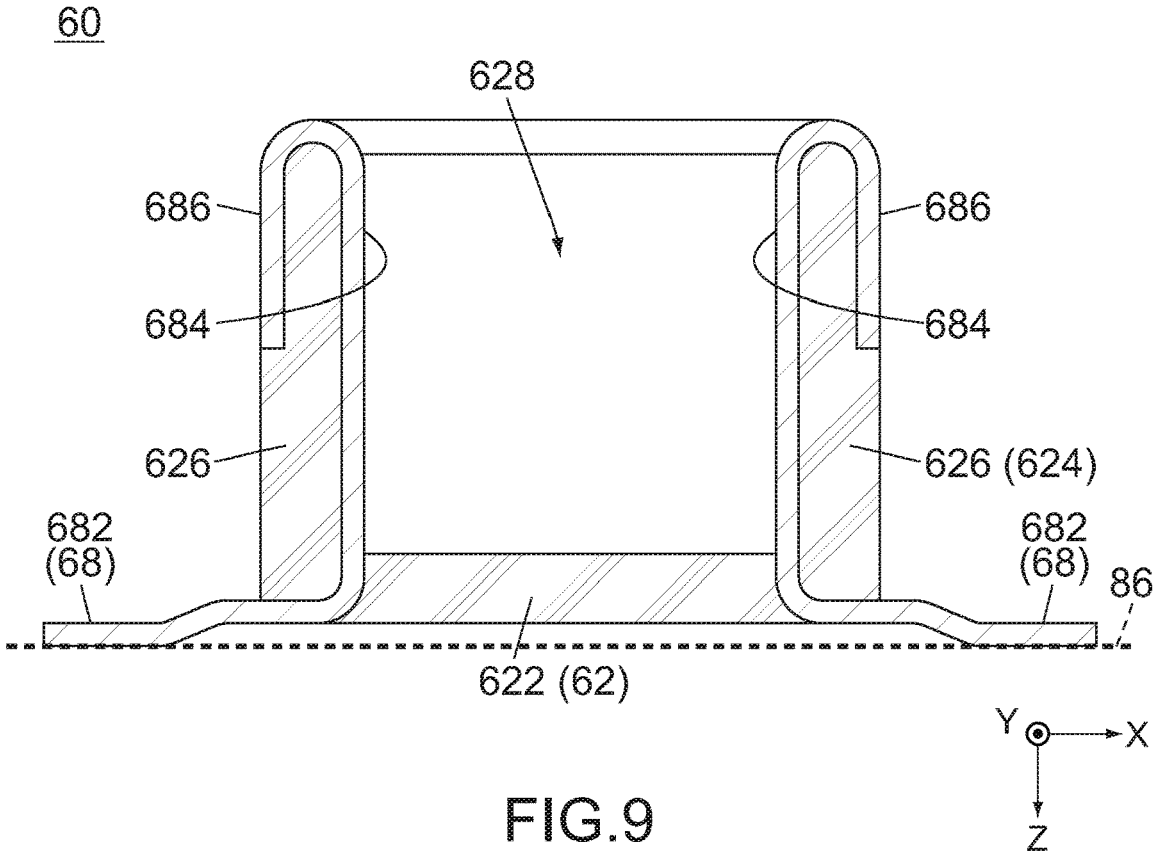
FIG. 9 is a cross-sectional view showing the mating connector of FIG. 8, taken along line IX-IX, wherein dashed line illustrates a part of the mating circuit board.

Referring to FIGS. 1 and 7 to 9, the mating connector 60 comprises a mating housing 62 made of insulator and a plurality of mating contacts 68 each made of conductor. The mating housing 62 has a base portion 622 and a mating peripheral wall 624. Referring to FIG. 9, the base portion 622 is mounted on and fixed to the mating circuit board 86 when the mating connector 60 is used. Referring to FIGS. 7 and 8, the mating peripheral wall 624 extends along the outer periphery of the base portion 622 in a horizontal plane (XY-plane) perpendicular to the Z-direction and extends away from the base portion 622 in the Z-direction. The mating peripheral wall 624 has two mating sidewalls 626. Each of the mating sidewalls 626 extends along the YZ-plane.

Figure 5:
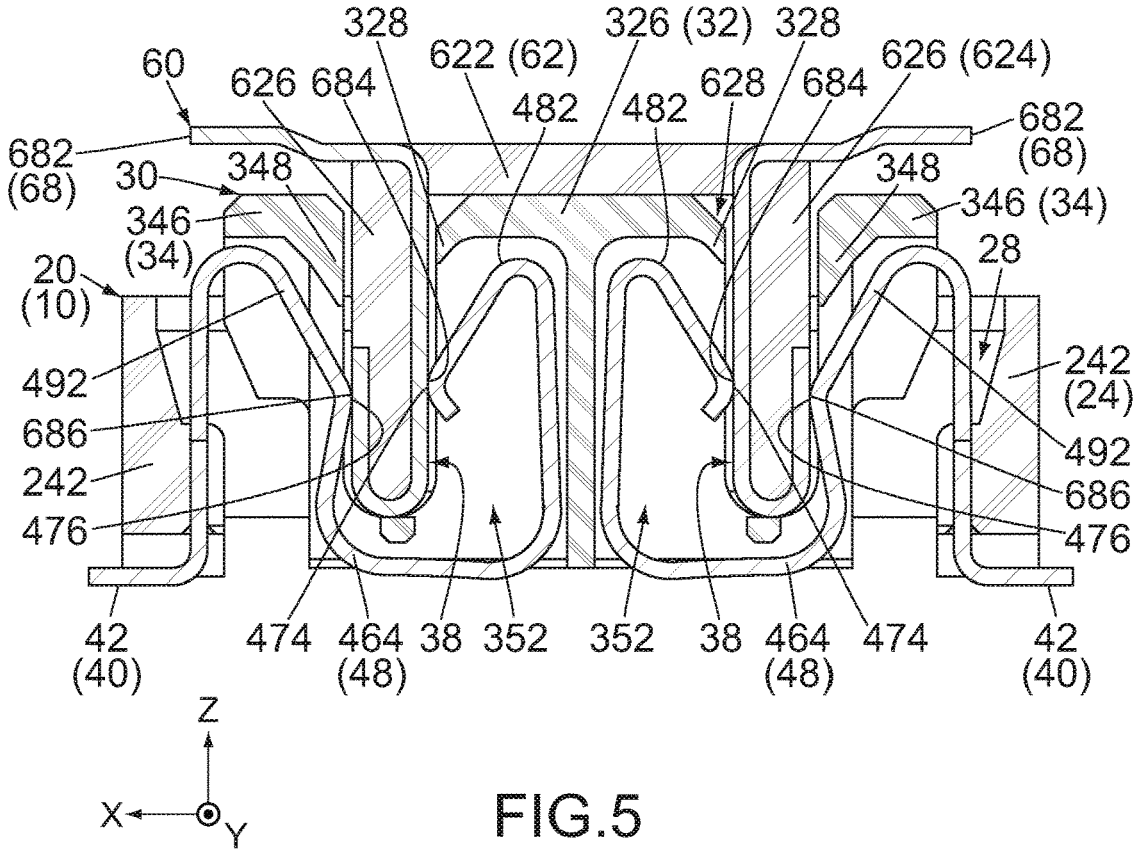
FIG. 5 is a cross-sectional view showing the connector and the mating connector of FIG. 4, taken along line V-V.

As shown in FIGS. 7 to 9, the mating housing 62 is formed with a mating receiving portion 628. The mating receiving portion 628 is a space enclosed by the mating peripheral wall 624 in the XY-plane. The two mating sidewalls 626 are located across the mating receiving portion 628 from each other in a width direction (X-direction) perpendicular to the Z-direction. Under a separated state (see FIG. 1) where the connector 10 (see FIG. 1) and the mating connector 60 are separated from each other, the mating receiving portion 628 opens at an opposite end of the mating housing 62 which is opposite to the base portion 622 in the Z-direction. Referring to FIG. 5, the mating receiving portion 628 receives, at least in part, the connector 10 under a mated state where the connector 10 and the mating connector 60 are mated with each other.

Referring to FIGS. 1, 7 and 8, the mating contacts 68 have shapes same as one another and are grouped into two rows in the X-direction. The two rows of the mating contacts 68 correspond to the two mating sidewalls 626, respectively. The two rows of the mating contacts 68 are arranged to be mirror images of each other with respect to the YZ-plane. In other words, the arrangement of the two rows of the mating contacts 68 is mirror-symmetrical with respect to the YZ-plane. The mating contacts 68 of each row are held by the corresponding mating sidewall 626 and are arranged at regular intervals in a pitch direction (Y-direction) perpendicular to both the X-direction and the Z-direction.

Referring to FIGS. 7 and 9, each of the mating contacts 68 is a single metal plate with bends and has a mating fixed portion 682, a first mating contact portion 684 and a second mating contact portion 686. Each of the mating fixed portions 682 is partially embedded in the base portion 622 and projects outward in the X-direction from the base portion 622. When the mating connector 60 is used, each of the mating fixed portions 682 is fixed and connected to a conductive pad (not shown) of the mating circuit board 86 via soldering, etc. Each of the first mating contact portions 684 is embedded in an inner part of the corresponding mating sidewall 626 and extends along the Z-direction while being partially exposed in the mating receiving portion 628. Each of the second mating contact portions 686 is embedded in an outer part of the corresponding mating sidewall 626 and extends along the Z-direction while being partially exposed outside the mating housing 62.

The mating connector 60 of the present embodiment has the aforementioned structure. However, the structure of the mating connector 60 can be variously modified in accordance with the structure of the connector 10.

Referring to FIGS. 1 and 10 to 12, the connector 10 comprises a fixed housing 20 made of insulator, a movable housing 30 made of insulator and a plurality of contacts 40 each of which is made of conductor and which correspond to the mating contacts 68, respectively. The connector 10 of the present embodiment consists of the aforementioned members. However, the connector 10 may further comprise another member. Hereafter, explanation will be made about the structure of each member of the connector 10.

Figure 11:
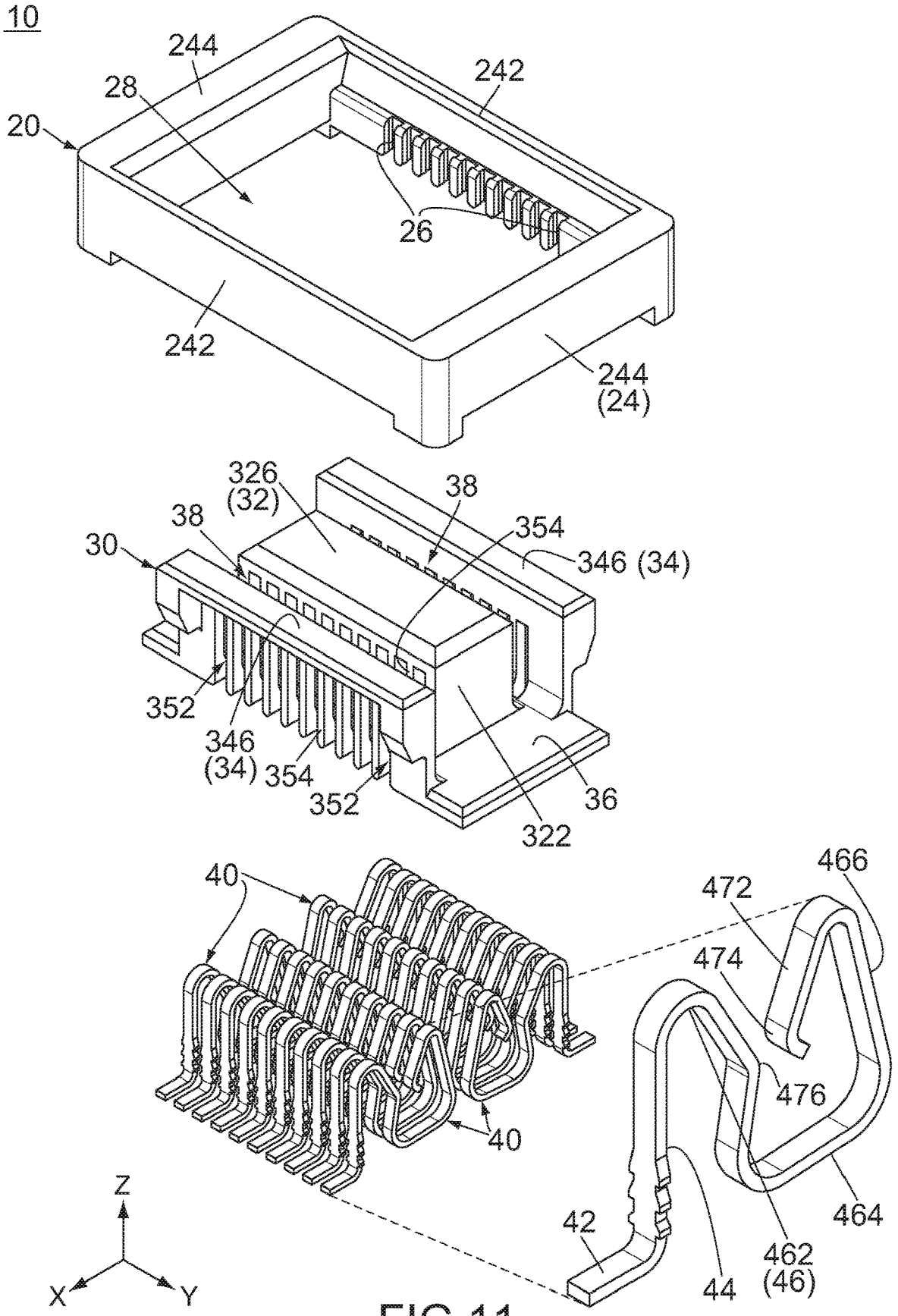
FIG. 11 is an exploded perspective view showing the connector of FIG. 1, wherein one of contacts thereof is enlarged to be illustrated.
Figure 12:
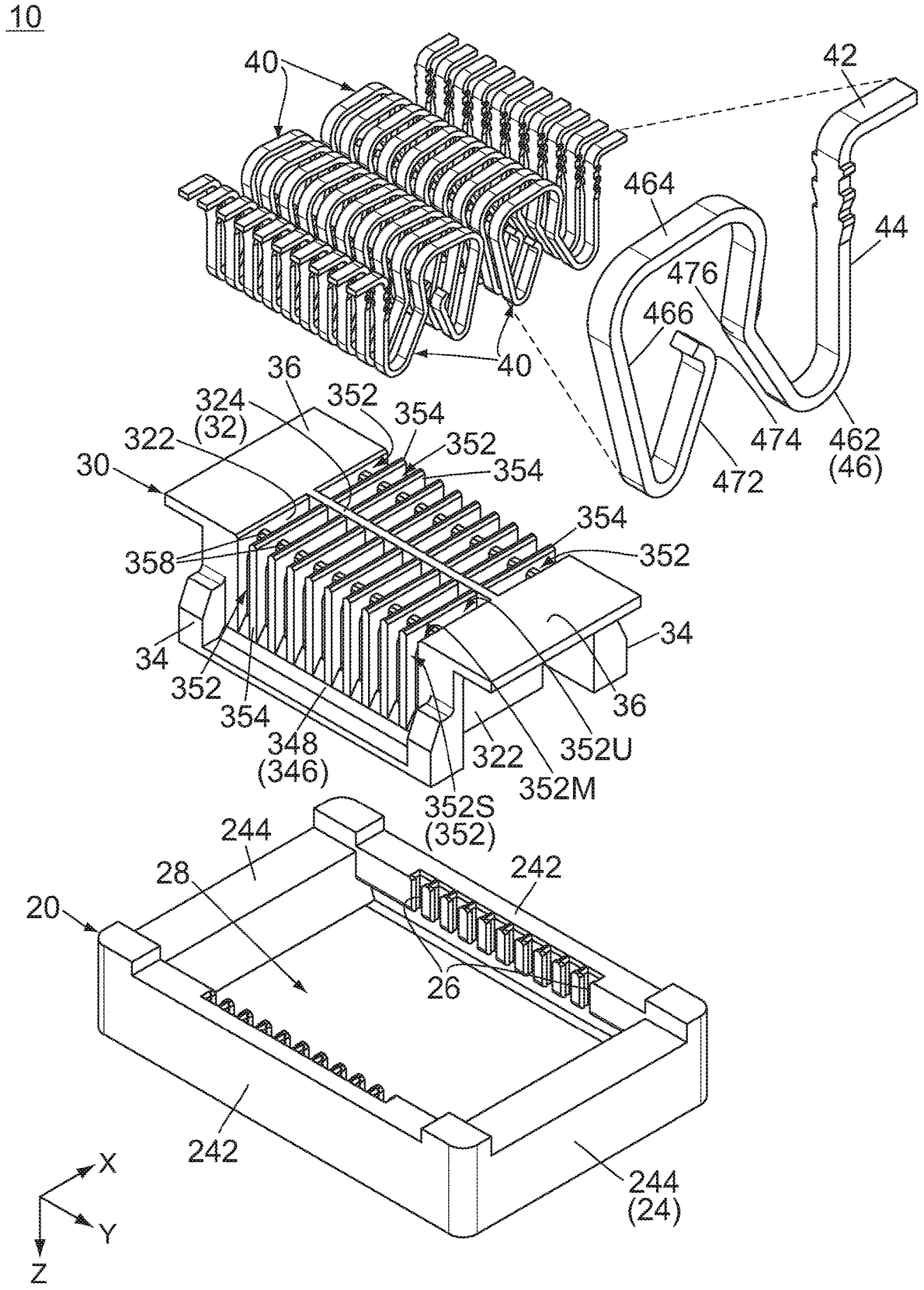
FIG. 12 is an exploded perspective view showing the connector of FIG. 10, wherein one of the contacts is enlarged to be illustrated.
Figure 13:
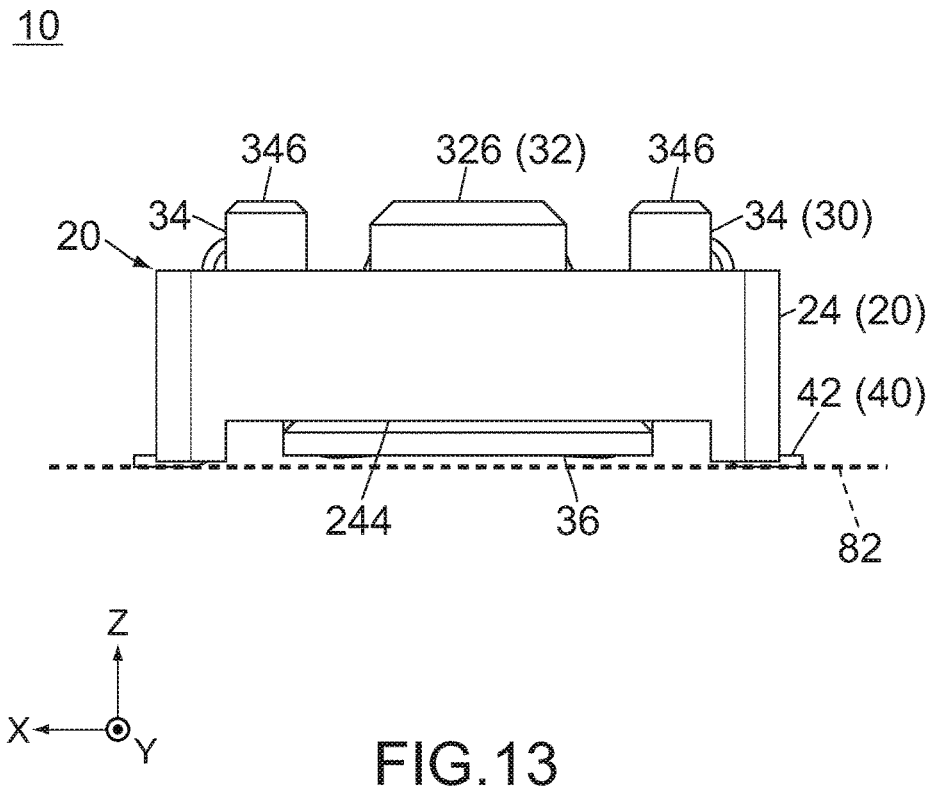
FIG. 13 is a side view showing the connector of FIG. 1, wherein dashed line illustrates a part of the circuit board.

Referring to FIG. 13, the fixed housing 20 is mounted on and fixed to the circuit board 82 when the connector 10 is used. Referring to FIGS. 11 and 12, the fixed housing 20 has a peripheral wall 24 and a housing-accommodation portion 28. The peripheral wall 24 of the present embodiment has a rectangular frame shape in the XY-plane. The housing-accommodation portion 28 is a space enclosed by the peripheral wall 24 in the XY-plane. The housing-accommodation portion 28 opens upward and downward, or opens in the positive Z-direction and in the negative Z-direction. However, the housing-accommodation portion 28 may open only upward.

The peripheral wall 24 has two sidewalls 242 and two coupling walls (movement restriction portions) 244. Each of the sidewalls 242 extends along the Y-direction. The two sidewalls 242 are located across the housing-accommodation portion 28 from each other in the X-direction. Each of the coupling walls 244 extends along the X-direction and couples the two sidewalls 242 to each other in the X-direction.

The fixed housing 20 has a plurality of holding portions 26 which correspond to the contacts 40, respectively. As described later, each of the holding portions 26 holds the corresponding contact 40. The holding portions 26 of the present embodiment are grouped into two rows in the X-direction. The holding portions 26 of each row have shapes same as one another and are arranged at regular intervals in the Y-direction. In the present embodiment, the two rows of the holding portions 26 are provided so as to correspond to the two sidewalls 242, respectively, and are arranged to be mirror images of each other with respect to the YZ-plane. In other words, the arrangement of the two rows of the holding portions 26 is mirror-symmetrical with respect to the YZ-plane. Moreover, each of the holding portions 26 is a groove formed on an inner part of the sidewall 242. However, the present invention is not limited thereto. For example, each of the holding portions 26 may have any structure, provided that the corresponding contact 40 can be held thereby. Moreover, the holding portions 26 may be formed on only one of the two sidewalls 242. In other words, the fixed housing 20 may have only one row of the holding portions 26 arranged in the Y-direction.

Referring to FIGS. 1, 11 and 12, the movable housing 30 of the present embodiment has a middle portion 32, two outer walls 34 and two flanges (restricted portions) 36. Each of the middle portion 32 and the outer walls 34 projects upward from a lower end, or the negative Z-side end, of the movable housing 30 and extends along the Y-direction. The middle portion 32 is located between the two outer walls 34 in the X-direction. The middle portion 32 has opposite lower ends in the X-direction which are connected to lower ends of the two outer walls 34, respectively. The flanges 36 are located at opposite sides of the movable housing 30 in the Y-direction, respectively. Each of the flanges 36 projects outward in the Y-direction from the lower end of the movable housing 30 and has a flat plate shape extending along the XY-plane. The movable housing 30 of the present embodiment has the middle portion 32, the outer walls 34 and the flanges 36 as described above. However, the structure of the movable housing 30 can be variously modified as described later.

Figure 14:
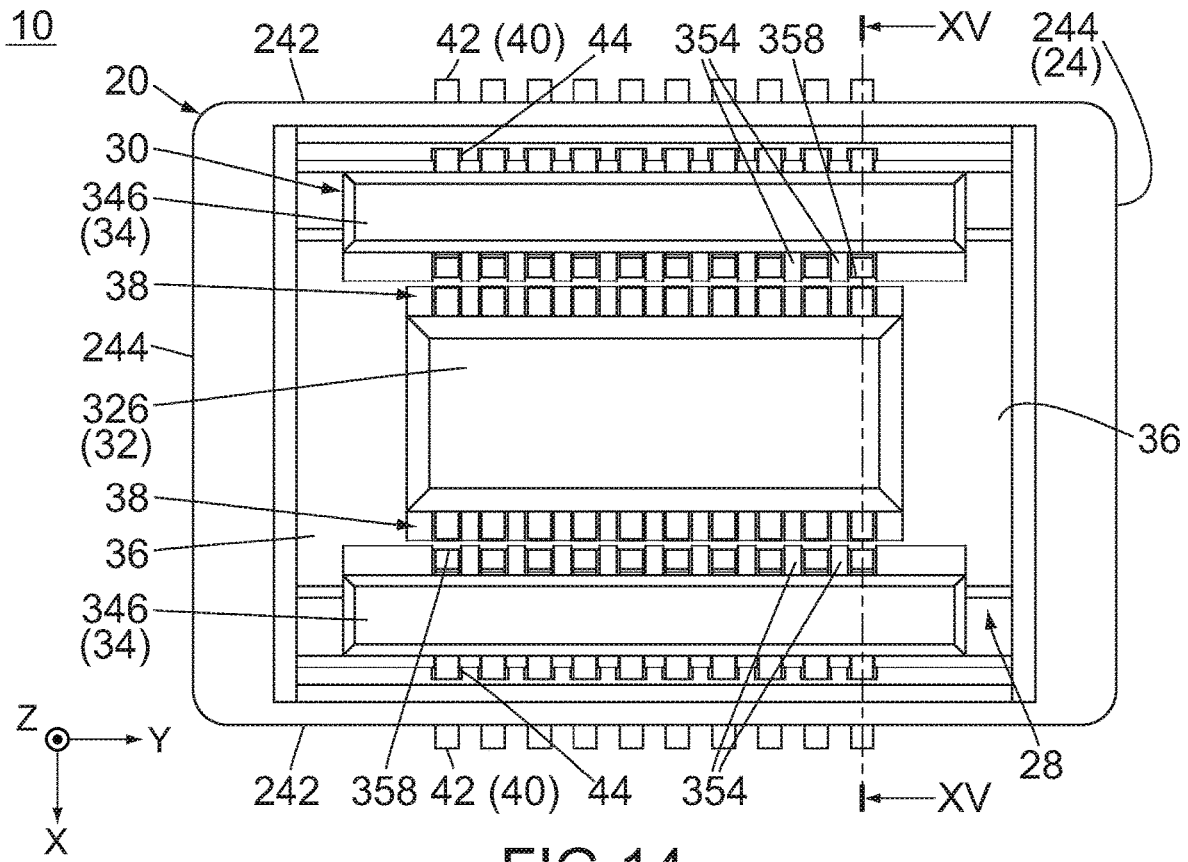
FIG. 14 is a plan view showing the connector of FIG. 1.

Referring to FIGS. 1, 11 and 14, the movable housing 30 has two receiving portions 38. Each of the receiving portions 38 is a space which opens upward. Referring to FIG. 5, the two receiving portions 38 of the present embodiment partially receive the two mating sidewalls 626 of the mating connector 60, respectively, under the mated state. However, the present invention is not limited thereto. The receiving portions 38 may receive a part provided with the mating contacts 68 of the mating connector 60 under the mated state. Thus, each of the receiving portions 38 may receives, at least in part, the mating connector 60 under the mated state.

In the present embodiment, the two receiving portions 38 correspond to the two outer walls 34, respectively. Each of the receiving portions 38 is located between the corresponding outer wall 34 and the middle portion 32 in the X-direction. However, the structure of the receiving portion 38 can be variously modified, provided that the movable housing 30 is provided with one or more of the receiving portions 38. For example, in a case where the movable housing 30 is not provided with the outer walls 34, two spaces which are located at opposite sides of the middle portion 32 in the X-direction may work as the receiving portions 38, respectively. In another case where the movable housing 30 is not provided with the middle portion 32, a space which is located between the two outer walls 34 in the X-direction may work as the receiving portion 38.

Figure 10:
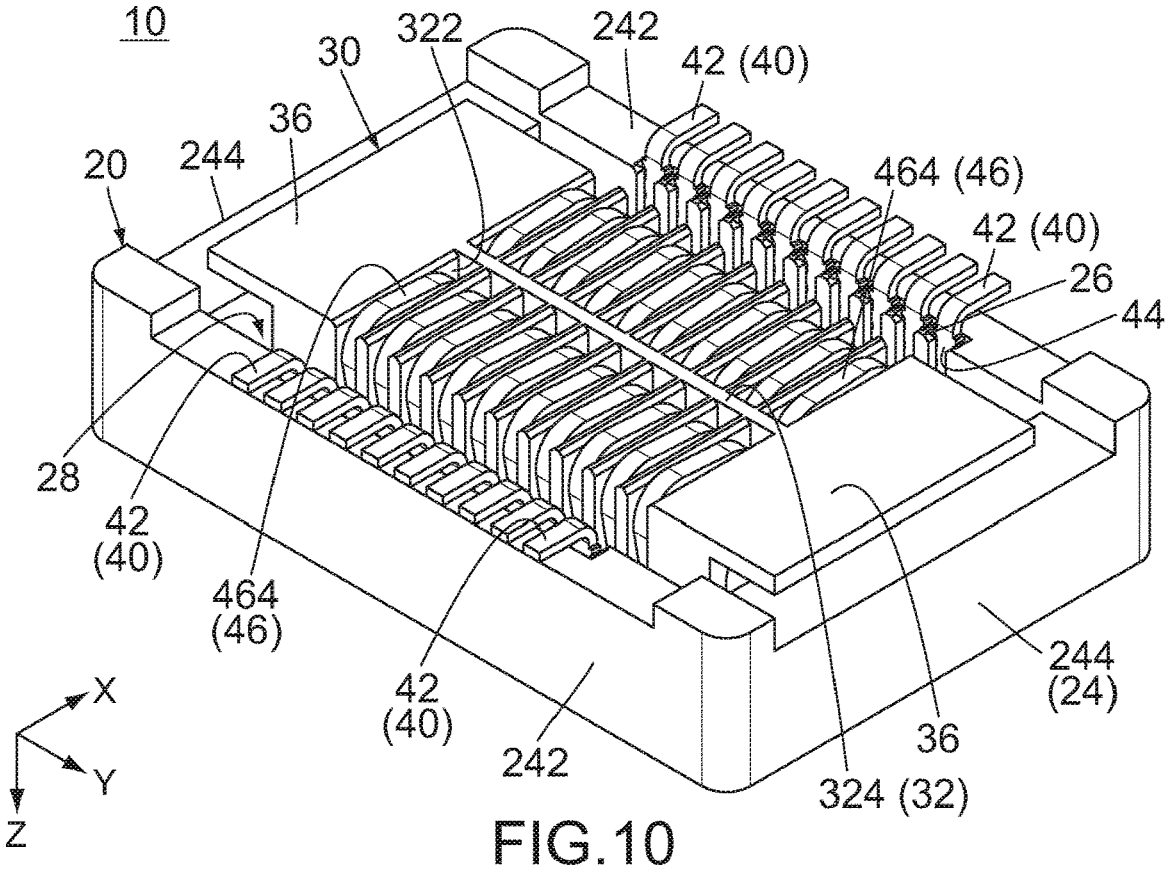
FIG. 10 is a perspective view showing the connector of FIG. 1.
Figure 16:
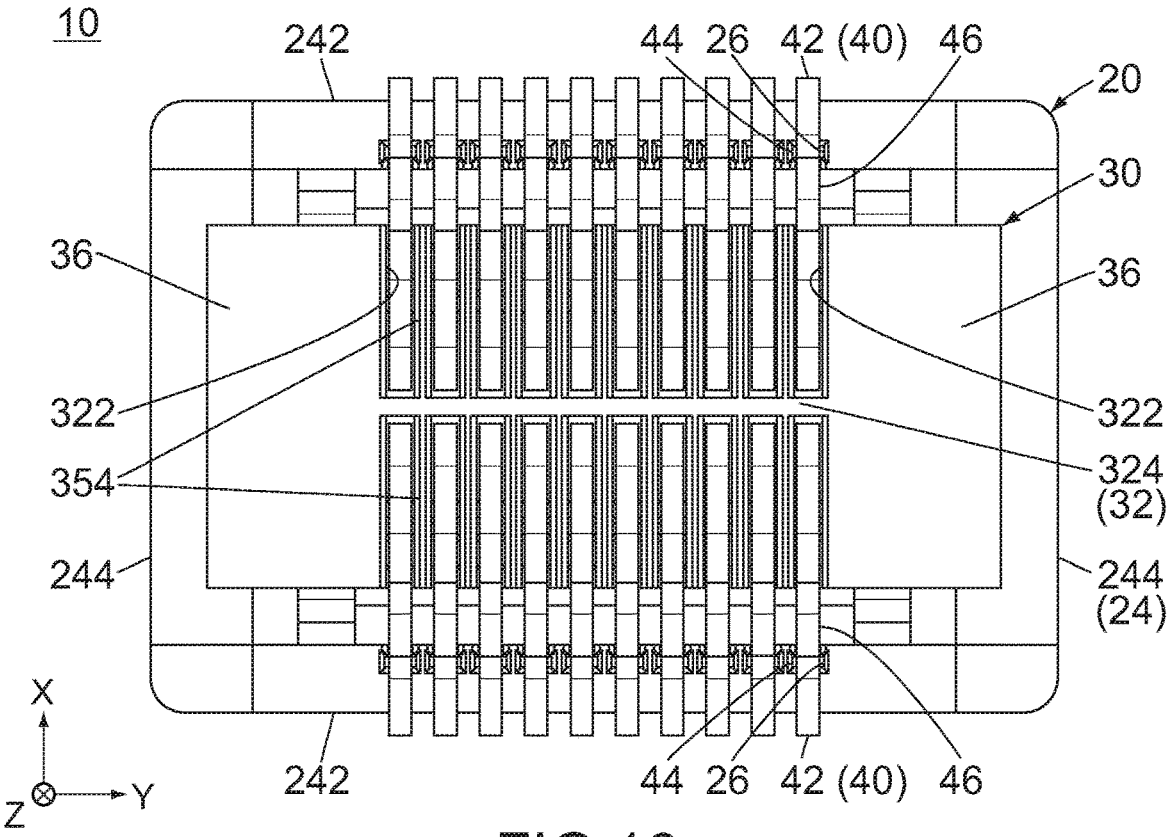
FIG. 16 is a plan view showing the connector of FIG. 10.
Figure 17:
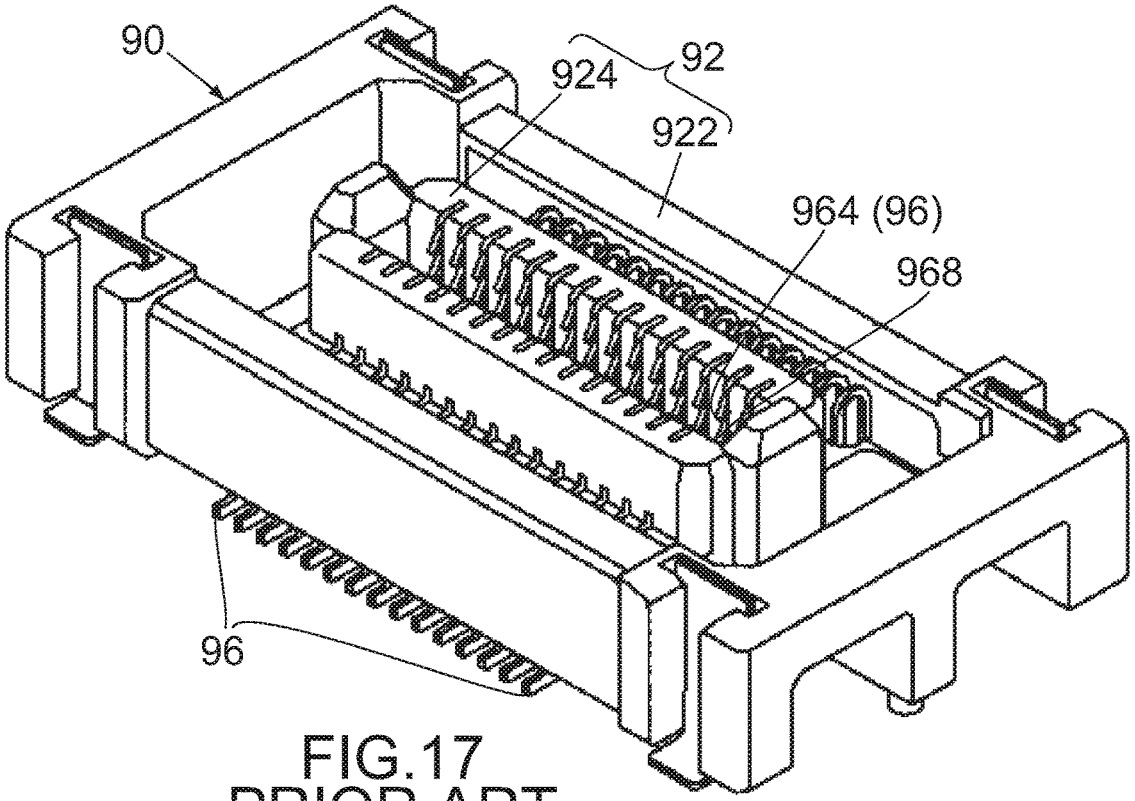
FIG.17 PRIOR ART
FIG. 17 is a perspective view showing a connector of Patent Document 1.
Figure 18:
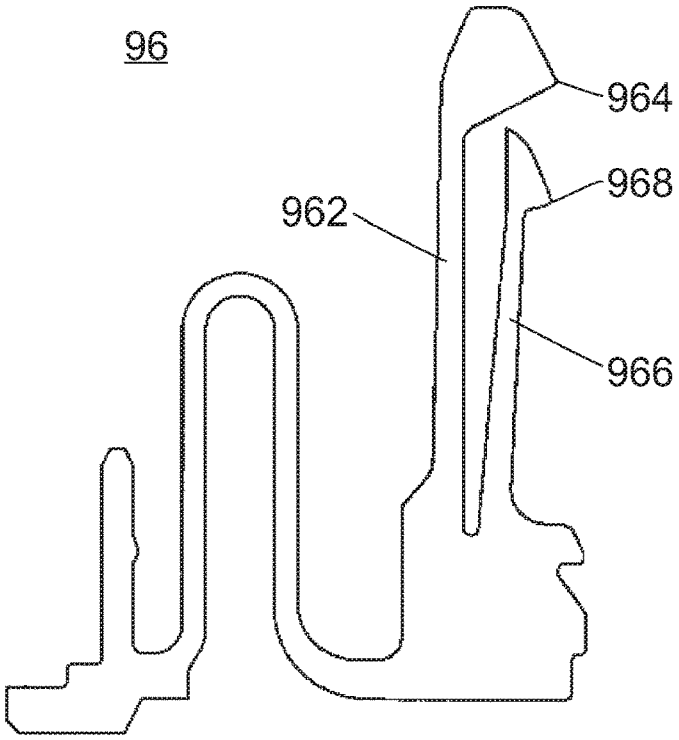
FIG.18 PRIOR ART
FIG. 18 is a side view showing one of terminals of the connector of FIG. 17.

Referring to FIGS. 10, 12 and 16, the middle portion 32 of the present embodiment has two end plates 322 and a separation portion 324. Referring to FIG. 12, the end plates 322 are located at opposite ends of the middle portion 32 in the Y-direction, respectively. Each of the end plates 322 extends in parallel to the XZ-plane. The separation portion 324 extends along the Y-direction in an area between the two end plates 322. The separation portion 324 is located at the middle of the middle portion 32 in the X-direction and extends along the YZ-plane. The movable housing 30 of the present embodiment has the end plates 322 and the separation portion 324 which are formed as described above. However, the present invention is not limited thereto. Each of the end plates 322 and the separation portion 324 may be provided as necessary as described later.

Referring to FIGS. 11 and 14, in the present embodiment, the middle portion 32 has a top plate 326, and each of the outer walls 34 has an additional top plate 346. The top plate 326 is located at an upper end, or the positive Z-side end, of the middle portion 32 and extends in parallel to the XY-plane as a whole. Each of the additional top plates 346 is located at an upper end of the outer wall 34 and extends in parallel to the XY-plane as a whole. Thus, the movable housing 30 of the present embodiment has the top plate 326 located at the upper end of the middle portion 32 and the two additional top plates 346 located at the upper ends of the outer walls 34, respectively. In the present embodiment, each of the top plate 326 and the additional top plates 346 is a part of the movable housing 30. However, the present invention is not limited thereto. Each of the top plate 326 and the additional top plates 346 may be a member separable from the movable housing 30 or may be provided as necessary as described later.

Referring to FIGS. 11 and 12, the movable housing 30 has a plurality of contact-accommodation portions 352 which correspond to the contacts 40, respectively. Each of the contact-accommodation portions 352 is a space which opens downward. The contact-accommodation portions 352 are grouped into two rows in the X-direction. The contact-accommodation portions 352 of each row have shapes same as one another and are arranged at regular interval in the Y-direction. The two rows of the contact-accommodation portions 352 are arranged to be mirror images of each other with respect to the YZ-plane. In other words, the arrangement of the two rows of the contact-accommodation portions 352 is mirror-symmetrical with respect to the YZ-plane. The two rows of the contact-accommodation portions 352 are provided so as to correspond to the two receiving portions 38, respectively. Thus, the two rows of the contact-accommodation portions 352 correspond to the two outer walls 34, respectively.

Figure 15:
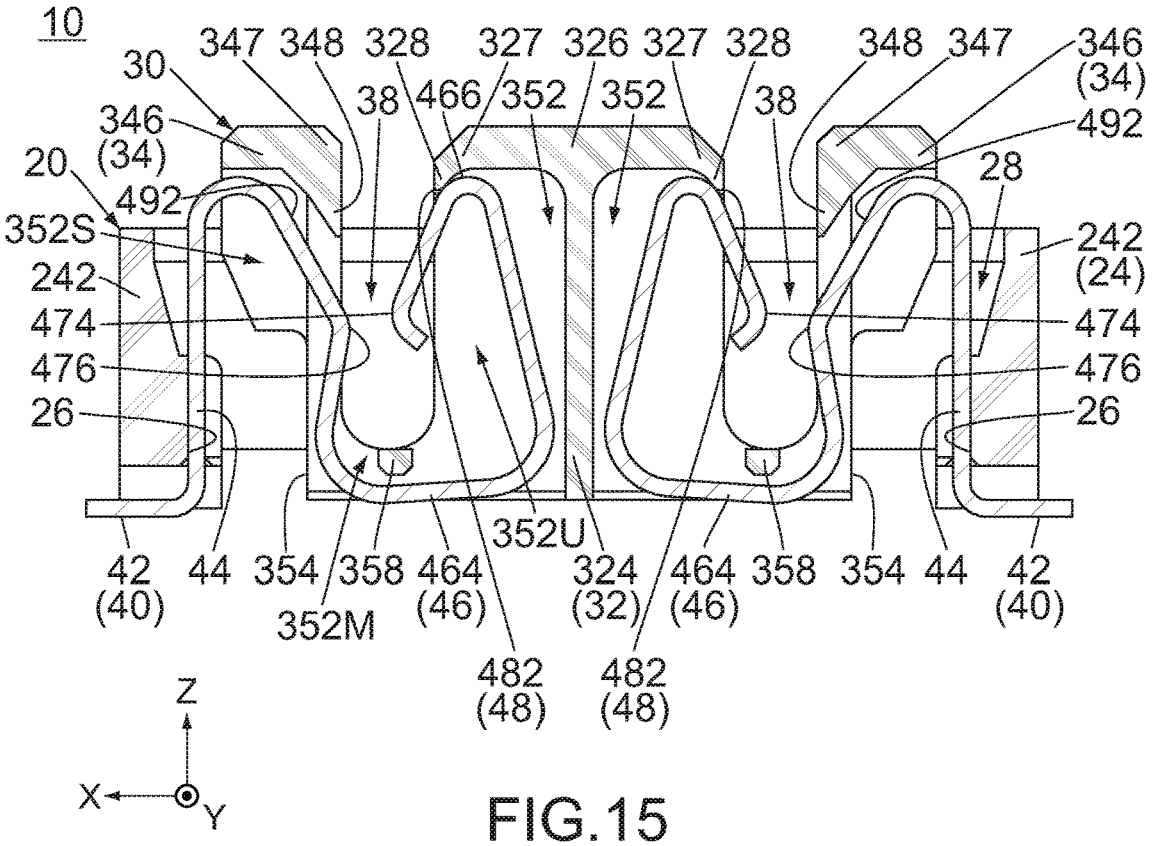
FIG. 15 is a cross-sectional view showing the connector of FIG. 14, taken along line XV-XV.

Referring to FIGS. 12 and 15, each of the outer walls 34 has an outer end in the X-direction. Each of the contact-accommodation portions 352 extends between the outer end of the corresponding outer wall 34 and the separation portion 324 of the middle portion 32 in the X-direction while having a constant size in the Y-direction. Each of the contact-accommodation portions 352 communicates with the corresponding receiving portion 38 in the X-direction. In detail, each of the contact-accommodation portions 352 includes an outer portion 352S, a middle portion 352M and an inner portion 352U. Each of the outer portions 352S is located under the additional top plate 346 of the corresponding outer wall 34 and is located adjacent to and outward of the corresponding receiving portion 38 in the X-direction. Each of the middle portions 352M is located under the corresponding receiving portion 38. Each of the inner portions 352U is located under the top plate 326 of the middle portion 32 and is located adjacent to and inward of the corresponding receiving portion 38 in the X-direction.

Referring to FIGS. 12 and 14, the movable housing 30 has a plurality of partitions 354 and a plurality of coupling portions 358. Referring to FIG. 12, each of the partitions 354 is located between adjacent two of the contact-accommodation portions 352 in the Y-direction and extends between the outer end of the corresponding outer wall 34 and the separation portion 324 of the middle portion 32 in the X-direction. The coupling portions 358 are provided so as to correspond to the contact-accommodation portions 352, respectively. Each of coupling portions 358 couples inner wall surfaces, which are located opposite sides of the corresponding contact-accommodation portion 352 in the Y-direction, respectively, to each other.

The contact-accommodation portions 352 of the present embodiment are formed and arranged as described above. However, the present invention is not limited thereto. For example, the size of each of the contact-accommodation portions 352 in the Y-direction is not limited to be constant. The contact-accommodation portions 352 may be provided so as to correspond only one of the outer walls 34. In other words, the movable housing 30 may have only one row of the contact-accommodation portions 352 and the partitions 354 arranged in the Y-direction. Moreover, in this structure, the number of the contact-accommodation portions 352 may be two, and the number of the partition 354 may be one. Thus, the movable housing 30 may have two or more of the contact-accommodation portions 352 and one or more of the partitions 354.

Referring to FIGS. 11 and 12, the contacts 40 of the present embodiment have shapes same as one another and are grouped into two rows in the X-direction so as to correspond to the contact-accommodation portions 352, respectively. The two rows of the contacts 40 are arranged to be mirror images of each other with respect to the YZ-plane. In other words, the arrangement of the two rows of the contacts 40 is mirror-symmetrical with respect to the YZ-plane. The contacts 40 of each row are arranged at regular intervals in the Y-direction. However, the present invention is not limited thereto. For example, the contacts 40 may have shapes different from one another. Moreover, the connector 10 may have only one row of the contacts 40 arranged in the Y-direction.

Each of the contacts 40 of the present embodiment is a single metal plate with bends and has a fixed portion 42, a held portion 44 and a resiliently deformable portion 46. The fixed portion 42 extends along the X-direction. The held portion 44 extends upward from an inner end of the fixed portion 42 in the X-direction. The resiliently deformable portion 46 extends and meanders in the XZ-plane so that the resiliently deformable portion 46 is resiliently deformable. In detail, each of the resiliently deformable portions 46 has an outer portion 462, a bottom portion 464 and an inner portion 466. The outer portion 462 arcuately extends upward and inward in the X-direction from an upper end of the held portion 44. Subsequently, the outer portion 462 extends downward and inward in the X-direction while partially protruding inward in the X-direction. The bottom portion 464 extends inward in the X-direction from a lower end of the outer portion 462. The inner portion 466 extends upward from an inner end of the bottom portion 464 in the X-direction. Subsequently, the inner portion 466 extends downward while partially protruding outward in the X-direction.

Each of the inner portions 466 has a guide portion 472 and a first contact point 474, and each of the outer portions 462 has a second contact point 476. The guide portion 472 extends downward and outward in the X-direction. The first contact point 474 and the second contact point 476 are located at positions almost same as each other in the Z-direction and protrude toward each other in the X-direction. As described above, each of the resiliently deformable portions 46 is provided with the first contact point 474 and the second contact point 476.

Referring to FIGS. 10 to 12, in the present embodiment, the aforementioned members are combined as described below, so that the connector 10 is formed. First, the movable housing 30 is inserted into the housing-accommodation portion 28 of the fixed housing 20 from below. The thus-inserted movable housing 30 is partially accommodated in the housing-accommodation portion 28. Then, each of the contacts 40 is attached to the fixed housing 20 from below. Each of the thus-attached contacts 40 is partially accommodated in the movable housing 30.

Referring to FIGS. 10 and 15, a lower end of the held portion 44 of each of the contacts 40 is press-fit into the corresponding holding portion 26 of the fixed housing 20 from below and is held by the corresponding holding portion 26. Referring to FIGS. 12 and 15, the resiliently deformable portion 46 of each of the contacts 40 is inserted into the corresponding contact-accommodation portion 352 while the coupling portion 358 passes through a gap between the first contact point 474 and the second contact point 476 so that the resiliently deformable portion 46 is partially accommodated in the corresponding contact-accommodation portion 352. Referring to FIG. 15, the fixed portion 42 of each of the contacts 40 is hereby exposed downward from the fixed housing 20. Referring to FIG. 13, when the connector 10 is used, each of the fixed portions 42 is fixed and connected to a conductive pad (not shown) of the circuit board 82 via soldering, etc.

As described above, the connector 10 of the present embodiment can be easily formed only by combining the movable housing 30 and the contacts 40 to the fixed housing 20 from below. However, the present invention is not limited thereto. For example, the movable housing 30 and the contacts 40 may be formed so as to be combinable to the fixed housing 20 from above.

Hereafter, explanation will be made about the structure of the connector 10 which is assembled as described above.

Referring to FIGS. 10 and 13 to 15, in the XY-plane, a part of the movable housing 30 is located in the housing-accommodation portion 28 while being apart from the peripheral wall 24 of the fixed housing 20. In addition, referring to FIGS. 10 and 13, the two restricted portions 36 are located under and apart from the two movement restriction portions 244 of the fixed housing 20, respectively. The thus-arranged movable housing 30 is movable relative to the fixed housing 20 along the Z-direction and is movable relative to the fixed housing 20 along the XY-plane. Thus, the connector 10 is a floating connector comprising the contacts 40 each having two contact points, namely the first contact point 474 and the second contact point 476.

According to the present embodiment, the movement restriction portions 244 are located above the restricted portions 36, respectively, and restrict an upward movement of the movable housing 30 relative to the fixed housing 20 within a predetermined range. This restriction of the upward movement prevents the movable housing 30 from coming out upward from the fixed housing 20. In addition, referring to FIG. 13, the circuit board 82 restricts a downward movement of the movable housing 30 relative to the fixed housing 20 when the connector 10 is used.

Referring to FIG. 10, in the present embodiment, the movement restriction portions 244 are the coupling walls 244 of the fixed housing 20, and the restricted portions 36 are the flanges 36 of the movable housing 30. Thus, the fixed housing 20 has the two movement restriction portions 244, and the movable housing 30 has the two restricted portions 36 which correspond to the movement restriction portions 244, respectively. Each of the movement restriction portions 244 is a part of the fixed housing 20, and each of the restricted portions 36 is a part of the movable housing 30. However, the present invention is not limited thereto. For example, a part of the fixed housing 20 other than the coupling walls 244 may work as a movement restriction portion, and a part of the movable housing 30 other than the flanges 36 may work as a restricted portion. Each of the movement restriction portions 244 may be a member separable from the fixed housing 20, and each of the restricted portions 36 may be a member separable from the movable housing 30. Each of the number of the movement restriction portions 244 and the number of the restricted portions 36 is not limited to two. Moreover, the movement restriction portions 244 and the restricted portions 36 may be provided as necessary.

According to the present embodiment, the peripheral wall 24 of the fixed housing 20 encloses the movable housing 30 in the XY-plane and restricts a movement of the movable housing 30 relative to the fixed housing 20 along the XY-plane within another predetermined range. However, the present invention is not limited thereto. For example, a part of the fixed housing 20 other than the peripheral wall 24 may restrict the relative movement of the movable housing 30 along the XY-plane.

Referring to FIG. 15, according to the present embodiment, each of the contacts 40 is held by and fixed to the fixed housing 20 only at the corresponding holding portion 26. These contacts 40 support the movable housing 30 from below, while each of the contacts 40 has no part which is held by or fixed to the movable housing 30. According to the present embodiment, a movable range of the resiliently deformable portion 46 of each of the contacts 40 can be made wide. Moreover, according to the present embodiment, each of the resiliently deformable portions 46 can be moved relative to the movable housing 30 and the fixed housing 20 while the movable housing 30 is kept at the position shown in FIG. 15 by using a jig (not shown), for example. In other words, each of the resiliently deformable portions 46 is movable relative to the fixed housing 20 with no movement of the movable housing 30 relative to the fixed housing 20.

The movable housing 30 can be moved upward from the position shown in FIG. 15 to a position at which the restricted portions 36 (see FIG. 13) are brought into abutment with the movement restriction portions 244 (see FIG. 13) with no contact with each of the contacts 40. In addition, the movable housing 30 which is thus moved upward from the position shown in FIG. 15 can be further moved along the XY-plane by a predetermined distance with no contact with each of the contacts 40. In other words, the movable housing 30 is movable relative to the fixed housing 20 with no movement of each of the resiliently deformable portions 46 relative to the fixed housing 20. However, the present invention is not limited thereto. Each of the contacts 40 may be held not only by the fixed housing 20 but also by the movable housing 30.

In each of the contacts 40, each of the first contact point 474 and the second contact point 476 is movable in the X-direction in accordance with resilient deformation of the resiliently deformable portion 46. According to the present embodiment, each of the resiliently deformable portions 46, which is resiliently deformable, can be shaped to have the two contact points, or the first contact point 474 and the second contact point 476. For example, by shaping the resiliently deformable portion 46 in a meander shape according to the present embodiment, the contact 40 can be reduced in size in the mating direction (Z-direction) while keeping spring characteristics of the resiliently deformable portion 46, so that the connector 10 can be reduced in size in the Z-direction. Moreover, according to the present embodiment, each of the receiving portions 38 of the movable housing 30 is, at least in part, located in the housing-accommodation portion 28 of the fixed housing 20. According to this arrangement, the connector 10 can be further reduced in size in the Z-direction.

As shown in FIGS. 13 and 15, according to the present embodiment, an upper part (positive Z-side part) of the middle portion 32 of the movable housing 30 and upper parts of the outer walls 34 project upward from the housing-accommodation portion 28. However, the present invention is not limited thereto. The movable housing 30 may be entirely located in the housing-accommodation portion 28. According to this structure, the connector 10 can be further reduced in size in the Z-direction. However, the present invention is not limited thereto. The movable housing 30 may be, at least in part, accommodated in the housing-accommodation portion 28.

Referring to FIGS. 1 and 7, in the present embodiment, the middle portion 32 of the movable housing 30 has a shape corresponding to the mating receiving portion 628 of the mating housing 62. Referring to FIG. 8, a size of the middle portion 32 in the XY-plane is slightly smaller than another size of the mating receiving portion 628 in the XY-plane. Referring to FIGS. 1 and 8, while the mating connector 60 is mated with the connector 10, the middle portion 32 is received into the mating receiving portion 628 so that the mating housing 62 is positioned relative to the movable housing 30 in the XY-plane. Thus, the middle portion 32 of the present embodiment works as a positioning portion which positions the mating connector 60. In particular, the two end plates 322 of the middle portion 32 position the mating connector 60 in the Y-direction. However, the present invention is not limited thereto. For example, a part other than the middle portion 32 may work as the positioning portion.

Referring to FIG. 16, according to the present embodiment, adjacent two of the contacts 40 in the Y-direction are separated from each other by one of the partitions 354. Each of the partitions 354 prevents the contacts 40 arranged in the Y-direction from being brought into contact with each other. In addition, while the mating connector 60 (see FIG. 1) is mated with the connector 10, each of the contacts 40 is positioned relative to the corresponding mating contact 68 (see FIG. 1) by the partitions 354 and the end plates 322. However, the partitions 354 do not need to be provided in such a case where each of the contacts 40 is sufficiently large in the Y-direction, and adjacent two of the contacts 40 in the Y-direction are sufficiently apart from each other.

Figure 3:
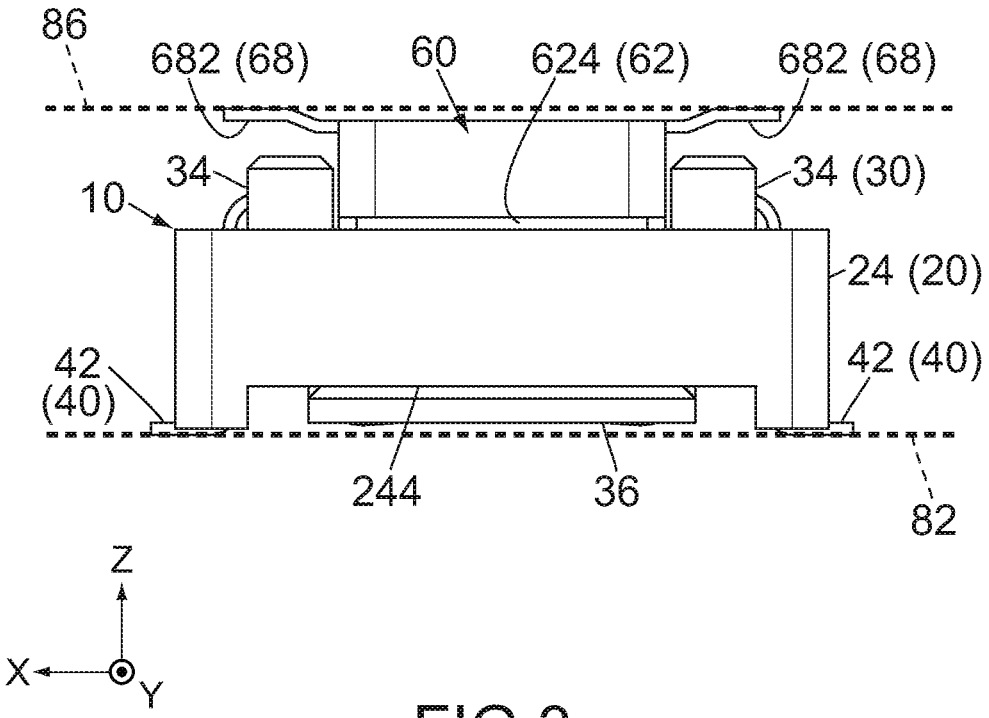
FIG. 3 is a side view showing the connector and the mating connector of FIG. 2, wherein dashed line illustrates a part of a circuit board on which the connector is mounted and a part of a mating circuit board on which the mating connector is mounted.
Figure 4:
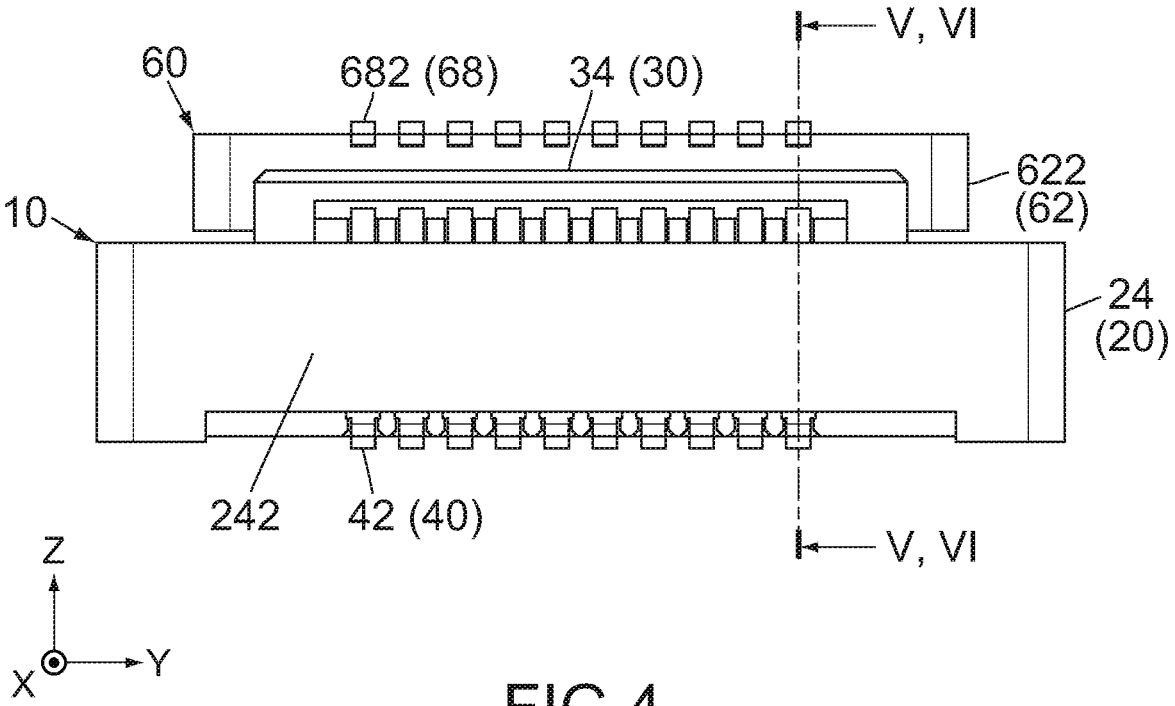
FIG. 4 is another side view showing the connector and the mating connector of FIG. 2.

Referring to FIG. 15, under the separated state, the first contact point 474 and the second contact point 476 of each of the contacts 40 are located in the corresponding receiving portion 38 and face each other in the X-direction. Referring to FIGS. 3 and 5, when the mating connector 60 is mated with the connector 10 without moving the movable housing 30 from the position under the separated state (see FIGS. 13 and 15) in the X-direction, the first contact point 474 and the second contact point 476 of each of the contacts 40 sandwich the corresponding mating contact 68 with pressure in the X-direction and are brought into contact with the first mating contact portion 684 and the second mating contact portion 686 of the corresponding mating contact 68, respectively. As a result, the connector 10 and the mating connector 60 are electrically connected with each other.

Referring to FIG. 15, each of the resiliently deformable portions 46 has an accommodated portion 48. Each of the accommodated portions 48 is a part which is located in the corresponding contact-accommodation portion 352 under a state where any part and any member of the connector 10 are applied with no force except the force due to their own weights. In other words, each of the accommodated portions 48 is accommodated in the corresponding contact-accommodation portion 352 under the separated state shown in FIG. 15.

According to the present embodiment, the accommodated portion 48 of each of the resiliently deformable portions 46 is, at least in part, located right under the top plate 326. In addition, each of the resiliently deformable portions 46 is partially located right under the corresponding additional top plate 346. Referring to FIG. 5, according to this structure, when the mating connector 60 is removed from the connector 10, each of the resiliently deformable portions 46 cannot be moved upward beyond the top plate 326 and the additional top plates 346. This structure of the present embodiment prevents damage of the contact 40 due to excessive resilient deformation of the resiliently deformable portion 46. However, the present invention is not limited thereto. Each of the top plate 326 and the additional top plates 346 may be provided as necessary.

Referring to FIG. 15, in the present embodiment, the top plate 326 has two outer ends 327 which correspond to the receiving portions 38, respectively, and two regulation portions 328 which correspond to the outer ends 327, respectively. The outer ends 327 are located at opposite ends of the top plate 326 in the X-direction and face the two receiving portions 38 in the X-direction, respectively. Thus, each of the outer ends 327 and the corresponding receiving portion 38 are adjacent to each other in the X-direction. Each of the regulation portions 328 extends downward from the corresponding outer end 327. Each of the accommodated portions 48 has a regulated portion 482 corresponding to one of the regulation portions 328. Under the separated state, each of the regulation portions 328 is located between the corresponding regulated portions 482 and the corresponding receiving portion 38 in the X-direction and regulates movements of the corresponding regulated portions 482 toward the corresponding receiving portion 38.

In the present embodiment, each of the additional top plates 346 has an inner end 347 and an additional regulation portion 348. Each of the inner ends 347 is located at an inner end of the additional top plate 346 in the X-direction and faces the corresponding receiving portion 38 in the X-direction. Thus, each of the inner ends 347 and the corresponding receiving portion 38 are adjacent to each other in the X-direction. In each of the additional top plates 346, the additional regulation portion 348 extends downward from the inner end 347. The part of each of the resiliently deformable portions 46, which is located right under the additional top plate 346, has an additional regulated portion 492. Under the separated state, each of the additional regulation portions 348 is located between the corresponding additional regulated portions 492 and the corresponding receiving portion 38 in the X-direction and regulates movements of the corresponding additional regulated portions 492 toward the corresponding receiving portion 38.

According to the present embodiment, the movement regulation by the regulation portions 328 prevents the resiliently deformable portions 46 from being damaged. In detail, damage of the resiliently deformable portion 46, which might occur when an upper end of the inner portion 466 of each of the resiliently deformable portions 46 is moved into the receiving portion 38, is prevented. Similarly, the movement regulation by the additional regulation portions 348 prevents the resiliently deformable portion 46 from being damaged.

According to the present embodiment, two of the contacts 40 which are located at positions same as each other in the Y-direction are separated from each other by the separation portion 324. Thus, the two rows of the contacts 40 separated in the X-direction are prevented by the separation portion 324 from being brought into contact with each other. In addition, the separation portion 324 regulates a movement of each of the resiliently deformable portions 46 toward the separation portion 324.

Figure 6:
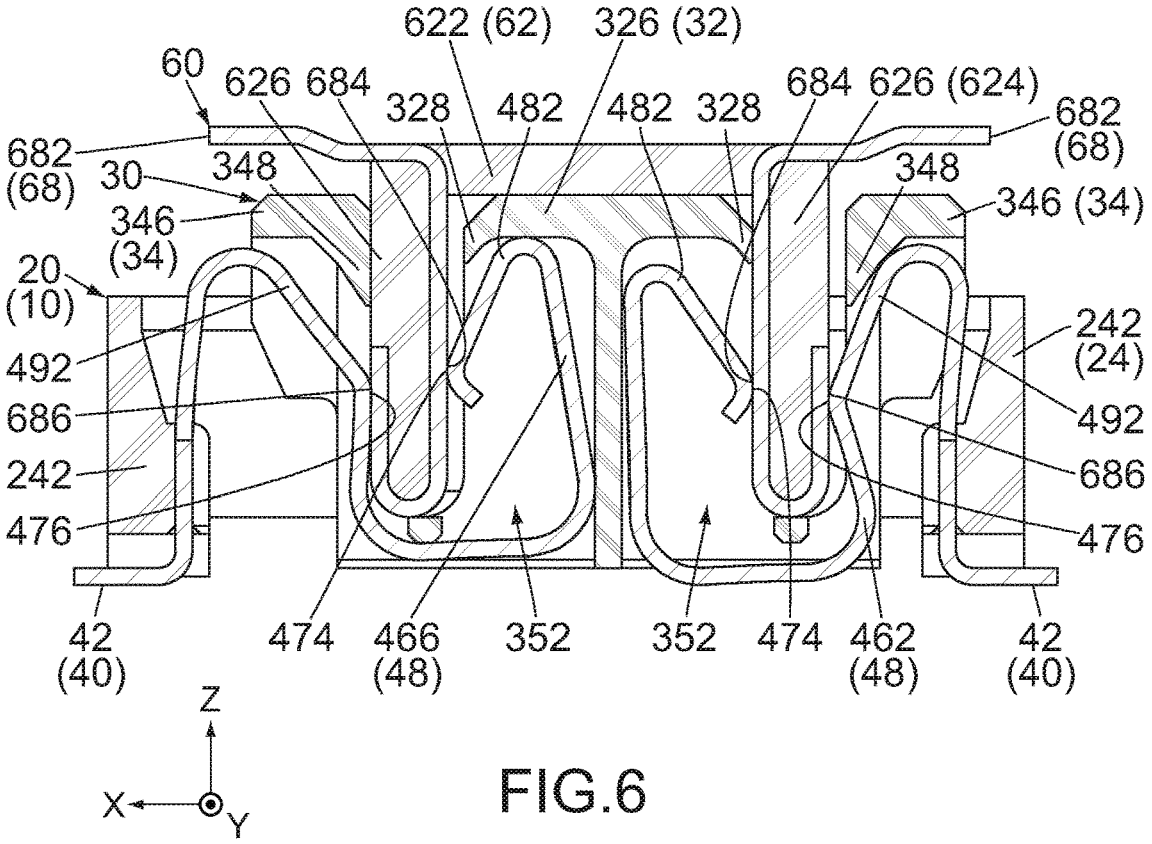
FIG. 6 is another cross-sectional view showing the connector and the mating connector of FIG. 4, taken along line VI-VI, wherein a movable housing of the connector is moved from the position shown in FIG. 5 along a width direction.

According to the present embodiment, as a result of the movement regulation by the regulation portions 328, the additional regulation portions 348 and the separation portion 324, each of the resiliently deformable portions 46 is moved so as to follow a movement of the movable housing 30 in the X-direction. Referring to FIG. 6, even if the movable housing 30 is moved from the position under the separated state (see FIG. 15) along the X-direction during a mating process of the mating connector 60 with the connector 10, the resiliently deformable portion 46 of each of the contacts 40 is moved along the X-direction with resilient deformation so as to follow the movement of the movable housing 30. As a result, the first contact point 474 and the second contact point 476 of each of the contacts 40 are brought into contact with the first mating contact portion 684 and the second mating contact portion 686 of the corresponding mating contact 68, respectively, in a well-balanced manner.

However, the present invention is not limited thereto. For example, each of the regulation portions 328 does not need to be a part of the top plate 326. Each of the additional regulation portions 348 does not need to be a part of the corresponding additional top plate 346. Moreover, each of the regulation portions 328, the additional regulation portions 348 and the separation portion 324 may be provided as necessary.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector along an upper-lower direction, wherein:

the connector comprises a fixed housing, a movable housing and a plurality of contacts;

the fixed housing has a housing-accommodation portion and a plurality of holding portions which correspond to the contacts, respectively;

the housing-accommodation portion opens upward;

the holding portions are arranged in a pitch direction perpendicular to the upper-lower direction;

the movable housing is, at least in part, accommodated in the housing-accommodation portion;

the movable housing is movable relative to the fixed housing along the upper-lower direction and is movable relative to the fixed housing along a horizontal plane perpendicular to the upper-lower direction;

the movable housing has a receiving portion, one or more partitions and a plurality of contact-accommodation portions which correspond to the contacts, respectively;

the receiving portion opens upward and receives, at least in part, the mating connector under a mated state where the connector and the mating connector are mated with each other;

the contact-accommodation portions are arranged in the pitch direction and communicate with the receiving portion in a width direction perpendicular to both the upper-lower direction and the pitch direction;

each of the partitions is located between adjacent two of the contact-accommodation portions in the pitch direction;

each of the contacts has a held portion and a resiliently deformable portion;

each of the held portions is held by a corresponding one of the holding portions;

each of the resiliently deformable portions is resiliently deformable and has an accommodated portion;

each of the accommodated portions is accommodated in a corresponding one of the contact-accommodation portions under a separated state where the connector and the mating connector are separated from each other;

each of the resiliently deformable portions is provided with a first contact point and a second contact point; and the first contact point and the second contact point of each of the contacts face each other in the width direction under the separated state.

2. The connector as recited in claim 1, wherein:

the fixed housing has a movement restriction portion;

the movable housing has a restricted portion; and the movement restriction portion is located above the restricted portion and restricts an upward movement of the movable housing relative to the fixed housing within a predetermined range.

3. The connector as recited in claim 1, wherein:

the movable housing has a regulation portion;

each of the accommodated portions has a regulated portion; and under the separated state, the regulation portion is located between the regulated portions and the receiving portion in the width direction and regulates movements of the regulated portions toward the receiving portion.

4. The connector as recited in claim 1, wherein:

the movable housing has a top plate; and each of the accommodated portions is, at least in part, located right under the top plate.

5. The connector as recited in claim 4, wherein:

the top plate has an outer end and a regulation portion;

the outer end and the receiving portion are adjacent to each other in the width direction;

the regulation portion extends downward from the outer end;

each of the accommodated portions has a regulated portion; and under the separated state, the regulation portion is located between the regulated portions and the receiving portion in the width direction and regulates movements of the regulated portions toward the receiving portion.

6. The connector as recited in claim 4, wherein:

the movable housing has an additional top plate; and each of the resiliently deformable portions is partially located right under the additional top plate.

7. The connector as recited in claim 6, wherein:

the additional top plate has an inner end and an additional regulation portion;

the inner end and the receiving portion are adjacent to each other in the width direction;

the additional regulation portion extends downward from the inner end;

a part of each of the resiliently deformable portions, which is located right under the additional top plate, has an additional regulated portion; and under the separated state, the additional regulation portion is located between the additional regulated portions and the receiving portion in the width direction and regulates movements of the additional regulated portions toward the receiving portion.

8. The connector as recited in claim 1, wherein the receiving portion is, at least in part, located in the housing-accommodation portion.

9. The connector as recited in claim 1, wherein each of the resiliently deformable portions is movable relative to the fixed housing with no movement of the movable housing relative to the fixed housing.

10. The connector as recited in claim 1, wherein the movable housing is movable relative to the fixed housing with no movement of each of the resiliently deformable portions relative to the fixed housing.

* * * * *